US006987086B2

(12) United States Patent
Deak et al.

(10) Patent No.: US 6,987,086 B2
(45) Date of Patent: Jan. 17, 2006

(54) COMPOSITIONS AND METHODS FOR REMOVAL OF INCIDENTAL SOILS FROM FABRIC ARTICLES

(75) Inventors: John Christopher Deak, West Chester, OH (US); Robert James Perry, Niskayuna, NY (US)

(73) Assignee: Procter & Gamble Company, Cincinnati, OH (US)

( * ) Notice: Subject to any disclaimer, the term of this patent is extended or adjusted under 35 U.S.C. 154(b) by 232 days.

(21) Appl. No.: 10/192,285

(22) Filed: Jul. 10, 2002

(65) Prior Publication Data

US 2003/0060396 A1 Mar. 27, 2003

Related U.S. Application Data

(60) Provisional application No. 60/304,333, filed on Jul. 10, 2001.

(51) Int. Cl.
*C11D 9/36* (2006.01)

(52) U.S. Cl. ..... 510/285; 510/276; 510/289; 510/290; 510/304; 510/338; 510/356; 510/357; 510/407; 510/417; 510/466

(58) Field of Classification Search ..... 510/276, 510/285, 289, 290, 304, 338, 356, 357, 407, 510/417, 466

See application file for complete search history.

(56) References Cited

U.S. PATENT DOCUMENTS

| | | | | |
|---|---|---|---|---|
| 2,787,596 | A | 4/1957 | Stewart et al. | |
| 4,102,824 | A | 7/1978 | Mizutani et al. | |
| 4,639,321 | A | 1/1987 | Barrat et al. | |
| 4,685,930 | A | 8/1987 | Kasprzak et al. | |
| 4,708,807 | A | 11/1987 | Kemerer et al. | |
| 5,057,240 | A | 10/1991 | Madore et al. | |
| 5,705,562 | A | 1/1998 | Hill et al. | |
| 5,707,613 | A | 1/1998 | Hill et al. | |
| 5,865,851 | A * | 2/1999 | Sidoti et al. | 8/142 |
| 5,865,852 | A | 2/1999 | Berndt et al. | |
| 5,876,510 | A | 3/1999 | Kuemin et al. | |
| 5,888,250 | A | 3/1999 | Hayday et al. | |
| 5,942,007 | A | 8/1999 | Berndt et al. | |
| 5,977,040 | A | 11/1999 | Inada et al. | |
| 5,985,810 | A | 11/1999 | Inada et al. | |
| 6,013,683 | A | 1/2000 | Hill et al. | |
| 6,042,617 | A | 3/2000 | Berndt et al. | |
| 6,042,618 | A | 3/2000 | Berndt et al. | |
| 6,056,789 | A | 5/2000 | Berndt et al. | |
| 6,059,845 | A | 5/2000 | Berndt et al. | |
| 6,060,546 | A | 5/2000 | Powell et al. | |
| 6,063,135 | A | 5/2000 | Berndt et al. | |
| 6,136,766 | A | 10/2000 | Inada et al. | |
| 6,156,074 | A | 12/2000 | Hayday et al. | |
| 6,177,399 | B1 | 1/2001 | Mei et al. | |
| 6,200,943 | B1 | 3/2001 | Romack et al. | |
| 6,258,130 | B1 | 7/2001 | Murphy et al. | |
| 6,273,919 | B1 | 8/2001 | Hayday et al. | |
| 6,309,425 | B1 | 10/2001 | Murphy et al. | |
| 6,310,029 | B1 | 10/2001 | Kilgour et al. | |
| 6,313,079 | B1 | 11/2001 | Murphy | |
| 6,368,359 | B1 | 4/2002 | Perry et al. | |
| 6,521,580 | B2 * | 2/2003 | Perry et al. | 510/285 |
| 6,548,465 | B2 * | 4/2003 | Perry et al. | 510/285 |
| 6,706,076 | B2 * | 3/2004 | Deak et al. | 8/137 |
| 6,706,677 | B2 * | 3/2004 | Burns et al. | 510/286 |
| 2001/0020308 | A1 | 9/2001 | Murphy et al. | |
| 2001/0034912 | A1 | 11/2001 | Kilgour et al. | |
| 2002/0004953 | A1 | 1/2002 | Perry et al. | |
| 2002/0115582 | A1 | 8/2002 | Perry et al. | |
| 2002/0174493 | A1 | 11/2002 | Perry et al. | |

FOREIGN PATENT DOCUMENTS

| | | | |
|---|---|---|---|
| DE | 26 44 073 | A1 | 4/1978 |
| DE | 37 39 711 | A1 | 6/1989 |
| EP | 0182 583 | A2 | 5/1986 |
| EP | 0982 023 | A2 | 3/2000 |
| EP | 1 041 189 | A1 | 10/2000 |
| EP | 1 043 443 | A1 | 10/2000 |
| EP | 1043443 | * | 10/2000 |
| EP | 1092 803 | A1 | 4/2001 |
| EP | 1092803 | * | 4/2001 |
| JP | 2000-290689 | | 10/2000 |
| WO | WO 98/44185 | | 10/1998 |
| WO | WO 99/16955 | | 4/1999 |
| WO | WO 00/04221 | | 1/2000 |
| WO | WO 00/04222 | | 1/2000 |
| WO | WO 00/63340 | | 10/2000 |
| WO | WO 01/40567 | A1 | 6/2001 |
| WO | WO 01/94678 | A1 | 12/2001 |
| WO | WO 01/94681 | A1 | 12/2001 |
| WO | WO 01/94684 | A1 | 12/2001 |
| WO | WO 02/97024 | | 5/2002 |
| WO | WO 02/46517 | A1 | 6/2002 |
| WO | WO 02/48447 | A1 | 6/2002 |
| WO | WO 02/50366 | A1 | 6/2002 |
| WO | WO 02/77356 | A1 | 10/2002 |

* cited by examiner

*Primary Examiner*—Charles Boyer
(74) *Attorney, Agent, or Firm*—Caroline Wei-Berk; C. Brant Cook; Kim W. Zerby

(57) ABSTRACT

Compositions for removing incidental soils from fabric articles, especially articles of clothing, linen and drapery, provide improved cleaning of incidental soils, either with or without a subsequent wash process. Methods for use of the compositions are also provided. The compositions and methods are safe for use on a wide range of fabric articles, even in the home.

34 Claims, No Drawings

COMPOSITIONS AND METHODS FOR REMOVAL OF INCIDENTAL SOILS FROM FABRIC ARTICLES

RELATED APPLICATIONS

This application claims priority to U.S. Provisional Application Ser. No. 60/304,333 filed on Jul. 10, 2001.

FIELD OF THE INVENTION

The present invention relates to compositions and methods for removing incidental soils from fabric articles, especially articles of clothing, linen and drapery, wherein the compositions provide improved cleaning of incidental soils, either with or without a subsequent wash process or other entire fabric care process. The compositions and methods are safe for use on a wide range of fabric articles, even in the home.

BACKGROUND OF THE INVENTION

The occurrence of incidental soils on fabric articles is a fact of life. If these soils cannot be removed from the fabric article, the article cannot be used again for its intended purpose because of its "dirty" appearance. The result is loss of use of an otherwise wearable garment, which is undesirable to the consumer because of the financial loss as well as the emotional attachment that some wearers have with clothing articles.

In the home, conventional laundry cleaning is carried out with relatively large amounts of water, typically in a washing machine at the consumer's home, or in a dedicated place such as a coin laundry. Although washing machines and laundry detergents have become quite sophisticated, the conventional laundry process still fails to remove some soils from fabric articles. A wide variety of "pre-treatment" compositions and devices are available to the consumer to assist in soil removal. These compositions often comprise enzymes, bleaching agents and surfactants and require a subsequent aqueous wash to complete soil removal. While effective in cleaning the soil, exposure of the fabric articles to high levels of water in the subsequent wash creates a risk of dye transfer and shrinkage. Moreover, a significant portion of fabric articles used by consumers is not suitable for cleaning in a conventional laundry process. Even fabric articles that are considered "washing machine safe" frequently come out of the laundry process badly wrinkled and require ironing, and may exhibit color loss.

More recently, home dry-cleaning kits have become available to the consumer. Some of these kits provide a means of treating incidental soils. However, these compositions comprise water and as such must be tested on fabric articles in an inconspicuous area prior to use, so as to ensure no fabric damage occurs (color bleeding, discoloration, residue formation, localized shrinkage, rings and the like).

Additionally, the consumer may desire to remove the incidental soil while still wearing the article, or just prior to re-wearing the article without subsequent treatment. Existing domestic pre-treatment systems can leave undesirable residues on clothing articles, even after an extended period of drying, and may visibly spread the soil over a larger area, creating rings around the original soil. These visible residues may leave the fabric article unusable without subsequent treatment, i.e. washing.

Accordingly there is an unmet need for compositions and methods for spot removal of soils from fabric articles which are safe for use in the home, safe for use on a wide range of fabric types including those sensitive to water, and which do not require subsequent conventional washing.

In contrast, commercial dry cleaning processes rely on non-aqueous solvents for cleaning. By avoiding water, these processes minimize the risk of shrinkage and wrinkling, however, cleaning of soils, particularly water-based and alcohol-based soils, is very limited with these processes. Typically, the dry-cleaner removes such soils manually prior to the dry-cleaning process. These methods are complex, requiring a wide range of compositions to address the variety of soils encountered, very labor intensive and often result in some localized damage to the treated article despite careful handling by the operator. Further complicating the process is the need to rinse or "level" the spot-treat fluid from the fabric article with solvent to avoid contaminating the non-aqueous fluid in the dry-cleaning machine with the spot-treatment chemicals.

Accordingly, there is also an unmet need in the dry-cleaning industry for cleaning compositions and methods that are simple to use, safe for use on dry-cleanable fabric articles, effective on a wide range of soils and which to not require additional treatment steps prior to the dry-cleaning operation.

SUMMARY OF THE INVENTION

The present invention provides safe-to-use compositions which exhibit improved cleaning of incidental soils from fabric articles, while maintaining excellent fabric care properties. Also provided are methods for utilizing these compositions that require no additional treatment steps before an optional subsequent cleaning or refreshing step.

In general, compositions of the present invention fall into two categories depending upon the amount of polar solvent desired. The polar solvent is desirable in the compositions of the present invention to improve hydrophilic soils as compared to compositions that lack such a polar solvent.

In one aspect of the present invention, when relatively low levels of polar solvent are desirable, a composition comprising: a) a lipophilic fluid; b) an amino-functional silicone; and c) a polar solvent, is provided.

In another aspect of the present invention, when relatively high levels of polar solvent are present, a composition comprising: a) lipophilic fluid; b) a surfactant component capable of suspending water in a lipophilic fluid and enhancing soil removal benefits of a lipophilic fluid; c) a polar solvent; and d) at least one additional non-solvent cleaning adjunct, is provided.

In another aspect of the present invention a method for removing incidental soils from a fabric article in need of treatment comprising: a) contacting the soiled area of the fabric article with a composition comprising: i) a lipophilic fluid; ii) an amino-functional silicone; and; iii) a polar solvent; and b) optionally, removing a portion of the composition from the fabric article; and c) optionally, placing the treated fabric article into a subsequent cleaning or refreshing process, such that the fabric article is treated, is provided.

In still yet another aspect of the invention, a method for removing incidental soils from a fabric article in need of treatment comprising: a) contacting the soiled area of the fabric article with a composition comprising: i) a lipophilic fluid; ii) a surfactant component capable of suspending water in a lipophilic fluid and enhancing soil removal benefits of a lipophilic fluid; iii) a polar solvent; and iv) at least one additional non-solvent cleaning adjunct; and b) optionally, removing a portion of the composition from the fabric article; and c) optionally, placing the treated fabric article into a subsequent cleaning or refreshing process, such that the fabric article is treated, is provided.

In yet another aspect of the present invention, an overall dry cleaning process for treating an entire surface area of a fabric article in need of treatment, wherein the process comprises the overall steps of:

(i) conducting a soil removal method according to the present invention, on localized soiled areas of the fabric article;

(ii) placing the entire treated fabric article from step (i) together with a carrier containing an aqueous cleaning composition in a containment bag;

(iii) placing the bag in a device, preferably a hot air clothes dryer, to provide agitation and agitating said bag; and (iv) removing the fabric article from the bag, such that the fabric article is treated, is provided.

In even yet another aspect of the present invention, an overall dry cleaning process for treating an entire surface area of a fabric article in need of treatment, wherein the process comprises the overall steps of:

(i) conducting a soil removal method according to the present invention, on localized soiled areas of the fabric article;

(ii) placing the entire treated fabric article from step (i) together with a carrier containing an aqueous cleaning composition into a device, preferably a hot air clothes dryer, to provide agitation and agitating said fabric article; and (iii) removing the fabric article from the device, such that the fabric article is treated, is provided.

In still yet another aspect of the present invention, an overall laundering process for a fabric article in need of treatment, wherein the process comprises the overall steps of:

(i) conducting a soil removal method according to the present invention on localized soiled areas of the fabric article; and (ii) laundering the entire treated fabric article from step (i) in a conventional aqueous laundering process, such that the fabric article is treated, is provided.

In even still yet another aspect of the present invention, an overall soil removal process for removing stains from fabrics comprises the overall steps of:

(i) conducting a soil removal method according to the present invention on localized soiled areas of the fabric article; and (ii) drying the fabric article, such as by air drying and/or by placing the fabric article in a device, preferably a hot air clothes dryer, to provide agitation and agitating said fabric article to dry the fabric, such that the fabric article is treated, is provided.

In another aspect of the present invention, a kit comprising a) a soil removal composition;

b) instructions for using the soil removal composition to remove soils from a article, preferably a fabric article; and c) optionally, a practice soil which comprises a practice article comprising a soil upon which a user can practice the instructions for using the soil removal composition; and d) optionally, an absorbent soil receiver article; and e) optionally, a liquid cleaning/refreshment composition, preferably releasably contained in a carrier sheet; and f) optionally, a containment bag, is provided.

Accordingly, the present invention provides methods for removing incidental soils from articles, preferably fabric articles, that avoids negative wicking effects, and products and kits comprising instructions for removing incidental soils.

These and other aspects, features and advantages will become apparent to those of ordinary skill in the art from a reading of the following detailed description and the appended claims. All percentages, ratios and proportions herein are by weight, unless otherwise specified. All temperatures are in degrees Celsius (° C.) unless otherwise specified. All measurements are in SI units unless otherwise specified. All documents cited are in relevant part, incorporated herein by reference.

DETAILED DESCRIPTION OF THE INVENTION

Definitions

The term "fabric article" and/or "fabric" used herein is intended to mean any article that is customarily cleaned in a conventional laundry process or in a dry cleaning process. As such the term encompasses articles of clothing, linen, drapery, and clothing accessories. The term also encompasses other items made in whole or in part of fabric, such as tote bags, furniture covers, tarpaulins and the like.

The term "lipophilic fluid" used herein is intended to mean any nonaqueous fluid capable of removing sebum, as described in more detail herein below.

The term "volatile silicone" describes the well-know class of materials exemplified by the oligomers of dimethyl siloxane. Said oligomers may be linear, branched or cyclic in nature. Preferred volatile silicones of the present invention are those that do not leave a visible residue at the end of the cleaning process. In general, preferred siloxane oligomers are those with a boiling point under normal conditions of 240° C. or lower.

The term "incidental soil" and/or "soil" refers to undesirable materials that are found on the fabric article. Generally, such incidental soils are found only on a portion of the article and are generated by accidental contact between the soil and the fabric article. Non-limiting examples of incidental soils are beverages, food sauces and condiments, bodily fluids such as blood, urine and feces, outdoor soils such as grass, mud and dirt, cosmetics such as make-up and lipstick. Such incidental soils are also commonly referred to as "stains". Incidental soils as used herein does not include soils, such as sebum (skin secretions), oil and/or grease that are spread out over large portions of the fabric article.

The term "cleaning composition" used herein is intended to mean any lipophilic fluid-containing composition that comes into direct contact with fabric articles to be cleaned. It should be understood that the term encompasses uses other than cleaning, such as conditioning and sizing.

The term "capable of suspending water in a lipophilic fluid" means that a material is able to suspend, solvate or emulsify water, which is immiscible with the lipophilic fluid, at a level of 5% by weight of the composition in a way that the water remains visibly suspended, solvated or emulsified when left undisturbed for a period of at least five minutes after initial mixing of the components. In some examples of compositions in accordance with the present invention, the compositions may be colloidal in nature and/or appear milky. In other examples of compositions in accordance with the present invention, the compositions may be transparent.

The term "insoluble in a lipophilic fluid" means that when added to a lipophilic fluid, a material physically separates from the lipophilic fluid (i.e. settle-out, flocculate, float) within 5 minutes after addition, whereas a material that is "soluble in a lipophilic fluid" does not physically separate from the lipophilic fluid within 5 minutes after addition.

The term "mixing" as used herein means combining two or more materials in such a way that a homogeneous mixture is formed. Suitable mixing processes are known in the art. Non-limiting examples of suitable mixing processes include vortex mixing processes and static mixing processes.

Compositions of the Present Invention

The present invention provides compositions which exhibit improved cleaning (i.e., removal and/or reduction) of incidental soils from fabric articles while maintaining excellent fabric care properties.

Lipophilic Fluid

The lipophilic fluid herein is one having a liquid phase present under operating conditions of a fabric article treating appliance, in other words, during treatment of a fabric article in accordance with the present invention. In general such a lipophilic fluid can be fully liquid at ambient temperature and pressure, can be an easily melted solid, e.g., one which becomes liquid at temperatures in the range from about 0 deg. C. to about 60 deg. C., or can comprise a mixture of liquid and vapor phases at ambient temperatures and pressures, e.g., at 25 deg. C. and 1 atm. pressure. Thus, the lipophilic fluid is not a compressible gas such as carbon dioxide.

It is preferred that the lipophilic fluids herein be nonflammable or have relatively high flash points and/or low VOC (volatile organic compound) characteristics, these terms having their conventional meanings as used in the dry cleaning industry, to equal or, preferably, exceed the characteristics of known conventional dry cleaning fluids.

Moreover, suitable lipophilic fluids herein are readily flowable and nonviscous.

In general, lipophilic fluids herein are required to be fluids capable of at least partially dissolving sebum or body soil as defined in the test hereinafter. Mixtures of lipophilic fluid are also suitable, and provided that the requirements of the Lipophilic Fluid Test, as described below, are met, the lipophilic fluid can include any fraction of dry-cleaning solvents, especially newer types including fluorinated solvents, or perfluorinated amines. Some perfluorinated amines such as perfluorotributylamines while unsuitable for use as lipophilic fluid may be present as one of many possible adjuncts present in the lipophilic fluid-containing composition.

Other suitable lipophilic fluids include, but are not limited to, diol solvent systems e.g., higher diols such as C6- or C8- or higher diols, organosilicone solvents including both cyclic and acyclic types, and the like, and mixtures thereof.

A preferred group of nonaqueous lipophilic fluids suitable for incorporation as a major component of the compositions of the present invention include low-volatility nonfluorinated organics, silicones, especially those other than amino functional silicones, and mixtures thereof. Low volatility nonfluorinated organics include for example OLEAN® and other polyol esters, or certain relatively nonvolatile biodegradable mid-chain branched petroleum fractions.

Another preferred group of nonaqueous lipophilic fluids suitable for incorporation as a major component of the compositions of the present invention include, but are not limited to, glycol ethers, for example propylene glycol methyl ether, propylene glycol n-propyl ether, propylene glycol t-butyl ether, propylene glycol n-butyl ether, dipropylene glycol methyl ether, dipropylene glycol n-propyl ether, dipropylene glycol t-butyl ether, dipropylene glycol n-butyl ether, tripropylene glycol methyl ether, tripropylene glycol n-propyl ether, tripropylene glycol t-butyl ether, tripropylene glycol n-butyl ether. Suitable silicones for use as a major component, e.g., more than 50%, of the composition include cyclopentasiloxanes, sometimes termed "D5", and/or linear analogs having approximately similar volatility, optionally complemented by other compatible silicones. Suitable silicones are well known in the literature, see, for example, Kirk Othmer's Encyclopedia of Chemical Technology, and are available from a number of commercial sources, including General Electric, Toshiba Silicone, Bayer, and Dow Corning. Other suitable lipophilic fluids are commercially available from Procter & Gamble or from Dow Chemical and other suppliers.

Qualification of Lipophilic Fluid and Lipophilic Fluid Test (LF Test)

Any nonaqueous fluid that is both capable of meeting known requirements for a dry-cleaning fluid (e.g, flash point etc.) and is capable of at least partially dissolving sebum, as indicated by the test method described below, is suitable as a lipophilic fluid herein. As a general guideline, perfluorobutylamine (Fluorinert FC-43®) on its own (with or without adjuncts) is a reference material which by definition is unsuitable as a lipophilic fluid for use herein (it is essentially a nonsolvent) while cyclopentasiloxanes have suitable sebum-dissolving properties and dissolves sebum.

The following is the method for investigating and qualifying other materials, e.g., other low-viscosity, free-flowing silicones, for use as the lipophilic fluid. The method uses commercially available Crisco® canola oil, oleic acid (95% pure, available from Sigma Aldrich Co.) and squalene (99% pure, available from J. T. Baker) as model soils for sebum. The test materials should be substantially anhydrous and free from any added adjuncts, or other materials during evaluation.

Prepare three vials, each vial will contain one type of lipophilic soil. Place 1.0 g of canola oil in the first; in a second vial place 1.0 g of the oleic acid (95%), and in a third and final vial place 1.0 g of the squalene (99.9%). To each vial add 1 g of the fluid to be tested for lipophilicity. Separately mix at room temperature and pressure each vial containing the lipophilic soil and the fluid to be tested for 20 seconds on a standard vortex mixer at maximum setting. Place vials on the bench and allow to settle for 15 minutes at room temperature and pressure. If, upon standing, a clear single phase is formed in any of the vials containing lipophilic soils, then the nonaqueous fluid qualifies as suitable for use as a "lipophilic fluid" in accordance with the present invention. However, if two or more separate layers are formed in all three vials, then the amount of nonaqueous fluid dissolved in the oil phase will need to be further determined before rejecting or accepting the nonaqueous fluid as qualified.

In such a case, with a syringe, carefully extract a 200-microliter sample from each layer in each vial. The syringe-extracted layer samples are placed in GC auto sampler vials and subjected to conventional GC analysis after determining the retention time of calibration samples of each of the three models soils and the fluid being tested. If more than 1% of the test fluid by GC, preferably greater, is found to be present in any one of the layers which consists of the oleic acid, canola oil or squalene layer, then the test fluid is also qualified for use as a lipophilic fluid. If needed, the method can be further calibrated using heptacosafluorotributylamine, i.e., Fluorinert FC-43 (fail) and cyclopentasiloxane (pass). A suitable GC is a Hewlett Packard Gas Chromatograph HP5890 Series II equipped with a split/splitless injector and FID. A suitable column used in determining the amount of lipophilic fluid present is a J&W Scientific capillary column DB-1HT, 30 meter, 0.25 mm id, 0.1 um film thickness cat# 1221131. The GC is suitably operated under the following conditions:

Carrier Gas: Hydrogen

Column Head Pressure: 9 psi

Flows: Column Flow @~1.5 ml/min.

Split Vent @~250–500 ml/min.

Septum Purge @1 ml/min.

Injection: HP 7673 Autosampler, 10 ul syringe, 1 ul injection

Injector Temperature: 350° C.

Detector Temperature: 380° C.

Oven Temperature Program: initial 60° C. hold 1 min.

rate 25° C./min.

final 380° C. hold 30 min.

Preferred lipophilic fluids suitable for use herein can further be qualified for use on the basis of having an excellent garment care profile. Garment care profile testing is well known in the art and involves testing a fluid to be qualified using a wide range of garment or fabric article components, including fabrics, threads and elastics used in seams, etc., and a range of buttons. Preferred lipophilic fluids for use herein have an excellent garment care profile, for example they have a good shrinkage and/or fabric puckering profile and do not appreciably damage plastic buttons. Certain materials which in sebum removal qualify for use as lipophilic fluids, for example ethyl lactate, can be quite objectionable in their tendency to dissolve buttons, and if such a material is to be used in the compositions of the present invention, it will be formulated with water and/or other solvents such that the overall mix is not substantially damaging to buttons. Other lipophilic fluids, D5, for example, meet the garment care requirements quite admirably. Some suitable lipophilic fluids may be found in granted U.S. Pat. Nos. 5,865,852; 5,942,007; 6,042,617; 6,042,618; 6,056,789; 6,059,845; and 6,063,135, which are incorporated herein by reference.

Lipophilic fluids can include linear and cyclic polysiloxanes, hydrocarbons and chlorinated hydrocarbons, with the exception of PERC which is explicitly not covered by the lipophilic fluid definition as used herein. (Specifically call out DF2000 and PERC). More preferred are the linear and cyclic polysiloxanes and hydrocarbons of the glycol ether, acetate ester, lactate ester families. Preferred lipophilic fluids include cyclic siloxanes having a boiling point at 760 mm Hg. of below about 250° C. Specifically preferred cyclic siloxanes for use in this invention are octamethylcyclotetrasiloxane, decamethylcyclopentasiloxane, and dodecamethylcyclohexasiloxane. Preferably, the cyclic siloxane comprises decamethylcyclopentasiloxane (D5, pentamer) and is substantially free of octamethylcyclotetrasiloxane (tetramer) and dodecamethylcyclohexasiloxane (hexamer).

However, it should be understood that useful cyclic siloxane mixtures might contain, in addition to the preferred cyclic siloxanes, minor amounts of other cyclic siloxanes including octamethylcyclotetrasiloxane and hexamethylcyclotrisiloxane or higher cyclics such as tetradecamethylcycloheptasiloxane. Generally the amount of these other cyclic siloxanes in useful cyclic siloxane mixtures will be less than about 10 percent based on the total weight of the mixture. The industry standard for cyclic siloxane mixtures is that such mixtures comprise less than about 1% by weight of the mixture of octamethylcyclotetrasiloxane.

Accordingly, the lipophilic fluid of the present invention preferably comprises more than about 50%, more preferably more than about 75%, even more preferably at least about 90%, most preferably at least about 95% by weight of the lipophilic fluid of decamethylcyclopentasiloxane. Alternatively, the lipophilic fluid may comprise siloxanes which are a mixture of cyclic siloxanes having more than about 50%, preferably more than about 75%, more preferably at least about 90%, most preferably at least about 95% up to about 100% by weight of the mixture of decamethylcyclopentasiloxane and less than about 10%, preferably less than about 5%, more preferably less than about 2%, even more preferably less than about 1%, most preferably less than about 0.5% to about 0% by weight of the mixture of octamethylcyclotetrasiloxane and/or dodecamethylcyclohexasiloxane.

The level of lipophilic fluid, when present in the fabric article treating compositions according to the present invention, is preferably from about 70% to about 99.99%, more preferably from about 90% to about 99.9%, and even more preferably from about 95% to about 99.8% by weight of the fabric article treating composition.

The level of lipophilic fluid, when present in the cleaning compositions according to the present invention, is preferably from about 60% to about 99.95%, more preferably from about 75% to about 99%, and even more preferably from about 80% to about 95% by weight of the cleaning composition. When relatively low levels of polar solvent are present, said cleaning compositions most preferably comprise from about 88% to about 99.8% lipophilic fluid by weight.

Surfactant Component

The surfactant component of the present invention can be a material that is capable of suspending water in a lipophilic fluid and/or enhancing soil removal benefits of a lipophilic fluid. The materials may be soluble in the lipophilic fluid.

One class of materials can include siloxane-based surfactants (siloxane-based materials). The siloxane-based surfactants in this application may be siloxane polymers for other applications. The siloxane-based surfactants typically have a weight average molecular weight from 500 to 20,000. Such materials, derived from poly(dimethylsiloxane), are well known in the art. In the present invention, not all such siloxane-based surfactants are suitable, because they do not provide improved cleaning of soils compared to the level of cleaning provided by the lipophilic fluid itself.

Suitable siloxane-based surfactants comprise a polyether siloxane having the formula:

$$M_aD_bD'_cD''_dM'_{2-a}$$

wherein a is 0–2; b is 0–1000; c is 0–50; d is 0–50, provided that a+c+d is at least M is $R^1{}_{3-e}X_eSiO_{1/2}$ wherein $R^1$ is independently H, or a monovalent hydrocarbon group, X is hydroxyl group, and e is 0 or 1;

M' is $R^2{}_3SiO_{1/2}$ wherein $R^2$ is independently H, a monovalent hydrocarbon group, or $(CH_2)_f$—$(C6H4)_gO$—$(C_2H_4O)_h$—$(C_3H_6O)_i$—$(C_kH_{2k}O)_j$—$R^3$, provided that at least one $R^2$ is $(CH_2)_f$—$(C6H4)_gO$—$(C_2H_4O)_h$—$(C_3H_6O)_i$—$(C_kH_{2k}O)_j$—$R^3$, wherein $R^3$ is independently H, a monovalent hydrocarbon group or an alkoxy group, f is 1–10, g is 0 or 1, h is 1–50, i is 0–50, j is 0–50, k is 4–8;

D is $R^4{}_2SiO_{2/2}$ wherein $R^4$ is independently H or a monovalent hydrocarbon group;

D' is $R^5{}_2SiO_{2/2}$ wherein $R^5$ is independently $R^2$ provided that at least one $R^5$ is $(CH_2)_f$—$(C6H4)_gO$—$(C_2H_4O)_h$—$(C_3H_6O)_i$—$(C_kH_{2k}O)_j$—$R^3$, wherein $R^3$ is independently H, a monovalent hydrocarbon group or an alkoxy group, f is 1–10, g is 0 or 1, h is 1–50, i is 0–50, j is 0–50, k is 4–8; and D" is $R^6{}_2SiO_{2/2}$ wherein $R^6$ is independently H, a monovalent hydrocarbon group or $(CH_2)_l(C_6H_4)_m(A)_n$-$[(L)_o$-$(A')_p$-$]_q$-$(L')_rZ(G)_s$, wherin l is 1–10; m is 0 or 1; n is 0–5; o is 0–3; p is 0 or 1; q is 0–10; r is 0–3; s is 0–3; $C_6H_4$ is unsubstituted or substituted with a $C_{1-10}$ alkyl or alkenyl; A and A' are each independently a linking moiety representing an ester, a keto, an ether, a thio, an amido, an amino, a $C_{1-4}$ fluoroalkyl, a $C_{1-4}$ fluoroalkenyl, a branched or straight chained polyalkylene oxide, a phosphate, a sulfonyl, a sulfate, an ammonium, and mixtures thereof; L and L' are each independently a $C_{1-30}$ straight chained or branched alkyl or alkenyl or an aryl which is unsubstituted or substituted; Z is a hydrogen, carboxylic acid, a hydroxy, a phosphato, a phosphate ester, a sulfonyl, a sulfonate, a sulfate, a branched or straight-chained polyalkylene oxide, a nitryl, a glyceryl, an aryl unsubstituted or substituted with a $C_{1-30}$alkyl or alkenyl, a carbohydrate unsubstituted or substituted with a $C_{1-10}$alkyl or alkenyl or an ammonium; G is an anion or cation such as $H^+$, $Na^+$, $Li^+$, $K^+$, $NH_4^+$, $Ca^{+2}$, $Mg^{+2}$, $Cl^-$, $Br^-$, $I^-$, mesylate or tosylate.

Examples of the types of siloxane-based surfactants described herein above may be found in EP-1,043,443A1, EP-1,041,189 and WO-01/34,706 (all to GE Silicones) and U.S. Pat. Nos. 5,676,705, 5,683,977, 5,683,473, and EP-1,092,803A1 (all to Lever Brothers).

Nonlimiting commercially available examples of suitable siloxane-based surfactants are TSF 4446 (ex. General Electric Silicones), XS69-B5476 (ex. General Electric Silicones); Jenamine HSX (ex. DelCon) and Y12147 (ex. OSi Specialties).

A second preferred class of materials suitable for the surfactant component is organic in nature. Preferred materials are organosulfosuccinate surfactants, with carbon chains of from about 6 to about 20 carbon atoms. Most preferred are organosulfosuccinates containing dialkly chains, each with carbon chains of from about 6 to about 20 carbon atoms. Also preferred are chains containing aryl or alkyl aryl, substituted or unsubstituted, branched or linear, saturated or unsaturated groups.

Nonlimiting commercially available examples of suitable organosulfosuccinate surfactants are available under the trade names of Aerosol OT and Aerosol TR-70 (ex. Cytec).

The surfactant component, when present in the fabric article treating compositions of the present invention, preferably comprises from about 0.01% to about 10%, more preferably from about 0.02% to about 5%, even more preferably from about 0.05% to about 2% by weight of the fabric article treating composition.

Polar Solvent

Compositions according to the present invention may further comprise a polar solvent. Non-limiting examples of polar solvents include: water, alcohols, glycols, polyglycols, ethers, carbonates, dibasic esters, ketones, other oxygenated solvents, and mixutures thereof. Further examples of alcohols include: C1–C126 alcohols, such as propanol, ethanol, isopropyl alcohol, etc. . . . , benzyl alcohol, and diols such as 1,2-hexanediol. The Dowanol series by Dow Chemical are examples of glycols and polyglycols useful in the present invention, such as Dowanol TPM, TPnP, DPnB, DPnP, TPnB, PPh, DPM, DPMA, DB, and others. Further examples include propylene glycol, butylene glycol, polybutylene glycol and more hydrophobic glycols. Examples of carbonate solvents are ethylene, propylene and butylene carbonantes such as those available under the Jeffsol tradename. Polar solvents for the present invention can be further identified through their dispersive ($\delta_D$), polar ($\delta_P$) and hydrogen bonding ($\delta_H$) Hansen solubility parameters. Preferred polar solvents or polar solvent mixtures have fractional polar ($f_P$) and fractional hydrogen bonding ($f_H$) values of $f_P>0.02$ and $f_H>0.10$, where $f_P=\delta_P/(\delta_D+\delta_P+\delta_H)$ and $f_H=\delta_H/(\delta_D+\delta_P+\delta_H)$, more preferably $f_p>0.05$ and $f_H>0.20$, and most preferably $f_P>0.07$ and $f_H>0.30$.

In the detergent composition of the present invention, the levels of polar solvent can be from about 0 to about 70%, preferably 1 to 50%, even more preferably 1 to 30% by weight of the detergent composition.

When the composition of the present invention comprises an amino-functional silicone as the only emulsifying agent, preferred levels of polar solvent are from about 0.01 to about 2%, preferably 0.05 to 0.8%, even more preferably 0.1 to 0.5% by weight of the composition.

When the composition of the present invention comprises higher levels of polar solvent, the compositions preferably comprise from about 2% to about 25%, more preferably from about 5% to about 20%, even more preferably from about 8% to about 15% by weight of the composition.

Cleaning Adjuncts

The compositions of the present invention optionally further comprise at least one additional cleaning adjunct. The cleaning adjuncts can vary widely and can be used at widely ranging levels. For example, detersive enzymes such as proteases, amylases, cellulases, lipases and the like as well as bleach catalysts including the macrocyclic types having manganese or similar transition metals all useful in laundry and cleaning products can be used herein at very low, or less commonly, higher levels. Cleaning adjuncts that are catalytic, for example enzymes, can be used in "forward" or "reverse" modes, a discovery independently useful from the fabric treating methods of the present invention. For example, a lipolase or other hydrolase may be used, optionally in the presence of alcohols as cleaning adjuncts, to convert fatty acids to esters, thereby increasing their solubility in the lipophilic fluid. This is a "reverse" operation, in contrast with the normal use of this hydrolase in water to convert a less water-soluble fatty ester to a more water-soluble material. In any event, any cleaning adjunct must be suitable for use in combination with a lipophilic fluid in accordance with the present invention.

Some suitable cleaning adjuncts include, but are not limited to, builders, surfactants, other than those described above with respect to the surfactant component, enzymes, bleach activators, bleach catalysts, bleach boosters, bleaches, alkalinity sources, antibacterial agents, colorants, perfumes, pro-perfumes, finishing aids, lime soap dispersants, odor control agents, odor neutralizers, polymeric dye transfer inhibiting agents, crystal growth inhibitors, photobleaches, heavy metal ion sequestrants, anti-tarnishing agents, anti-microbial agents, anti-oxidants, anti-redeposition agents, soil release polymers, electrolytes, pH modifiers, thickeners, abrasives, divalent or trivalent ions, metal ion salts, enzyme stabilizers, corrosion inhibitors, diamines or polyamines and/or their alkoxylates, suds stabilizing polymers, solvents, process aids, fabric softening agents, optical brighteners, hydrotropes, suds or foam suppressors, suds or foam boosters and mixtures thereof.

Suitable odor control agents, which may optionally be used as finishing agents, include agents include, cyclodextrins, odor neutralizers, odor blockers and mixtures thereof. Suitable odor neutralizers include aldehydes, flavanoids, metallic salts, water-soluble polymers, zeolites, activated carbon and mixtures thereof.

Perfumes and perfumery ingredients useful in the compositions of the present invention comprise a wide variety of natural and synthetic chemical ingredients, including, but not limited to, aldehydes, ketones, esters, and the like. Also included are various natural extracts and essences which can comprise complex mixtures of ingredients, such as orange oil, lemon oil, rose extract, lavender, musk, patchouli, balsamic essence, sandalwood oil, pine oil, cedar, and the like. Finished perfumes may comprise extremely complex mixtures of such ingredients. Pro-perfumes are also useful in the present invention. Such materials are those precursors or mixtures thereof capable of chemically reacting, e.g., by hydrolysis, to release a perfume, and are described in patents and/or published patent applications to Procter and Gamble, Firmenich, Givaudan and others.

Bleaches, especially oxygen bleaches, are another type of cleaning adjunct suitable for use in the compositions of the present invention. This is especially the case for the activated and catalyzed forms with such bleach activators as nonanoyloxybenzenesulfonate and/or any of its linear or branched higher or lower homologs, and/or tetraacetylethylenediamine and/or any of its derivatives or derivatives of phthaloylimidoperoxycaproic acid (PAP) or other imido- or amido-substituted bleach activators including the lactam types, or more generally any mixture of hydrophilic and/or hydrophobic bleach activators (especially acyl derivatives including those of the $C_6$-$C_{,16}$ substituted oxybenzenesulfonates).

Also suitable are organic or inorganic peracids both including PAP and other than PAP. Suitable organic or inorganic peracids for use herein include, but are not limited to: percarboxylic acids and salts; percarbonic acids and salts; perimidic acids and salts; peroxymonosulfuric acids and salts; persulphates such as monopersulfate; peroxyacids such as diperoxydodecandioic acid (DPDA); magnesium peroxyphthalic acid; perlauric acid; perbenzoic and alkylperbenzoic acids; and mixtures thereof.

One class of suitable organic peroxycarboxylic acids has the general formula:

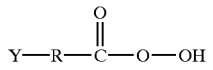

wherein R is an alkylene or substituted alkylene group containing from 1 to about 22 carbon atoms or a phenylene or substituted phenylene group, and Y is hydrogen, halogen, alkyl, aryl, —C(O)OH or —C(O)OOH.

Particularly preferred peracid compounds are those having the formula:

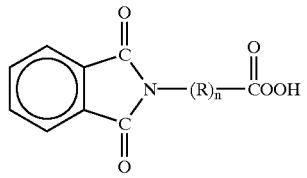

wherein R is $C_{1-4}$ alkyl and n is an integer of from 1 to 5. A particularly preferred peracid has the formula where R is $CH_2$ and n is 5 i.e., phthaloylamino peroxy caproic acid (PAP) as described in U.S. Pat. Nos. 5,487,818, 5,310,934, 5,246,620, 5,279,757 and 5,132,431. PAP is available from Ausimont SpA under the tradename Euroco.

Hydrogen peroxide is a highly preferred bleaching agent.

Other cleaning adjuncts suitable for use in the compositions of the present invention include, but are not limited to, builders including the insoluble types such as zeolites including zeolites A, P and the so-called maximum aluminum P as well as the soluble types such as the phosphates and polyphosphates, any of the hydrous, water-soluble or water-insoluble silicates, 2,2'-oxydisuccinates, tartrate succinates, glycolates, NTA and many other ethercarboxylates or citrates; chelants including EDTA, S,S'-EDDS, DTPA and phosphonates; water-soluble polymers, copolymers and terpolymers; soil release polymers; optical brighteners; processing aids such as crisping agents and/fillers; anti-redeposition agents; hydrotropes, such as sodium, or calcium cumene sulfonate, potassium napthalenesulfonate, or the like, humectant; other perfumes or pro-perfumes; dyes; photobleaches; thickeners; simple salts; alkalis such as those based on sodium or potassium including the hydroxides, carbonates, bicarbonates and sulfates and the like; and combinations of one or more of these cleaning adjuncts.

One particularly preferred class of cleaning adjuncts is additives comprising a strongly polar and/or hydrogen-bonding head group, further enhances soil removal by the compositions of the present invention. Examples of the strongly polar and/or hydrogen-bonding head group are alcohols, carboxylic acids, sulfates, sulphonates, phosphates, phosphonates, and nitrogen containing materials. Preferred additives are nitrogen containing materials selected from the group consisting of primary, secondary and tertiary amines, diamines, triamines, ethoxylated amines, amine oxides, amides, betaines, quaternary ammonium salts, and mixtures thereof. Most highly preferred materials are amino-functional siloxanes, having one or more of the following properties: i) at least about 60% by weight silicone content; and ii) alkyleneoxy groups, most preferably ethyleneoxy groups.

The cleaning adjunct(s) preferably comprise(s) from about 0.01% to about 10%, more preferably from about 0.02% to about 7%, even more preferably from about 0.05% to about 5% by weight of the composition.

Methods

In a preferred method of soil removal of the present invention, the soil removal composition of the present invention is used in conjunction with an absorbent soil receiver and is releasably housed within a container, which is provided with a dispensing means. (The combination of container and its dispensing means is herein referred to conjointly as the "dispenser"). In the process of this invention, a fabric is inspected for any localized area of stain. The soiled area is then placed in close contact with an absorbent soil receiver and treated by means of the dispenser.

As discussed herein, the compositions of the present invention may be employed in a process for removing a soil from a localized stained area on a fabric article, comprising the steps of placing the soiled area of the fabric over and in contact with an absorbent soil receiver; applying a composition according to the present invention to said soil, preferably from a container having a dispenser spout.

The absorbent soil receiver that is used in the pre-spotting operation herein can be any absorbent material, which imbibes the composition of the present invention used in the pre-spotting operation. Disposable paper towels, cloth towels such as BOUNTY™ brand towels, clean rags, etc., can be used. However, in a preferred mode the absorbent soil receiver is designed specifically to "wick" or "draw" the soil removal composition away from the soiled area. A preferred receiver consists of a nonwoven pad. In a preferred embodiment, the overall nonwoven is an absorbent structure composed of about 72% wood pulp and about 28% bicomponent staple fiber polyethylene-polypropylene (PE/PP). It is about 60 mils thick. It optionally, but preferably, has a barrier film on its rear surface to prevent the soil removal composition from passing onto the surface on which the pre-spotting operation is being conducted. The receiver's structure establishes a capillary gradient from its upper, fluid receiving layer to its lower layer. The gradient is achieved by controlling the density of the overall material and by layering the components such that there is lower capillary suction in the upper layer and greater capillary suction force within the lower layer. The lower capillary suction comes from having greater synthetic staple fiber content in the upper layer (these fibers have surfaces with higher contact angles, and correspondingly lower affinity for water, than wood pulp fibers) than in the lower layer. Additional soil receivers that may be employed in the present invention are disclosed in U.S. Pat. No. 5,489,039, the disclosure of which is herein incorporated by reference.

Another type of soil receiver for use herein comprises Functional Absorbent Materials ("FAM's"), which are in the form of water-absorbent foams having a controlled capillary size. The physical structure and resulting high capillarity of FAM-type foams provide very effective water absorption, while at the same time the chemical composition of the FAM typically renders it highly lipophilic. Thus, the FAM can essentially provide both hydrophilicity and lipophilicity simultaneously. (FAM foams can be treated to render them hydrophilic. Both the hydrophobic or hydrophilic FAM can be used herein.)

For pre-spotting, the soiled area of the garment or fabric swatch is placed over a section of the soil receiver, followed by treatment with the soil removal composition of the present invention, preferably in conjunction with the tip of the dispenser tube to provide mechanical agitation. Repeated manipulations with the tip and the detergency effect of the soil removal composition serve to loosen the soil and transfer it to the receiver. While spot cleaning progresses, the suction effects of the receiver capillaries cause the soil removal composition and soil debris to be carried into the receiver, where the soil debris is largely retained. At the end of this step the soil as well as almost all of the soil removal composition is found to have been removed from the fabric being treated and transferred to the receiver. This leaves the fabric surface only damp, with little or no residue of the soil removal composition/soil debris that can lead to undesirable rings on the fabrics.

A typical dispenser herein has the following dimensions, which are not to be considered limiting thereof. The volume of the container bottle used on the dispenser is typically 2 oz.–4 oz. (fluid ounces; 59 mls to 118 mls). The container larger size bottle can be high density polyethylene. Low density polyethylene is preferably used for the smaller bottle since it is easier to squeeze. The overall length of the spout is about 0.747 inches (1.89 cm). The spout is of a generally conical shape, with a diameter at its proximal base (where it joins with the container bottle) of about 0.596 inches (1.51 cm) and at its distal of 0.182 inches (4.6 mm). The diameter of the channel within the spout through which the pre-spotting fluid flows is approximately 0.062 inches (1.57 mm). In this embodiment, the channel runs from the container bottle for a distance of about 0.474 inches (1.2 cm) and then expands slightly as it communicates with the concavity to form the exit orifice at the distal end of the spout.

Another method for removing soils from fabric articles that can be used with the compositions of the present invention is to initially encircle the soiled area to be treated (or substantially encircle if the soiled area is on an edge of the fabric article) with the soil removal composition prior to contacting the soiled area with the soil removal composition.

Kits

Another embodiment of the soil removal method of the present invention further comprises the step of placing the treated fabric article in a subsequent cleaning or refreshment cycle. The present invention also encompasses an overall dry cleaning process for treating an entire area of a fabric surface comprising the steps of (i) conducting the soil removal method as described herein on localized soiled areas of the fabrics; placing the entire fabric from step (i) together with a carrier containing an aqueous cleaning composition in a containment bag; (iii) placing the bag in a device to provide agitation and agitating said bag; and (iv) removing the fabric from the bag. Step (iii) may be conducted in a hot air dryer. The present invention further encompasses an overall laundering process for fabrics comprising the steps of (i) conducting the soil removal method as described herein on localized soiled areas of the fabrics and (ii) laundering the entire fabrics from step (i) in a conventional aqueous laundering process, a conventional dry cleaning process, or a home dry cleaning process.

The products of the present invention (soil removal composition plus instructions for using) may be incorporated into kits in accordance with the present invention.

In a preferred embodiment, a kit in accordance with the present invention comprises a soil removal composition and instructions for removing soils and a containment bag, preferably a reusable containment bag, more preferably a fabric reusable containment bag. Nonlimiting examples of such containment bags are described in U.S. Pat. Nos. 5,789,368 and 5,681,355 and U.S. Patent Application Ser. No. 60/190,640 and PCT Publication No. WO 00/37733.

Cleaning/Refreshment Composition

The kits of the present invention preferably further comprise a cleaning/refreshment composition preferably releasably absorbed in a carrier sheet. The carrier sheet preferably comprises a differential elongation composite material. By "releasably contains" it is meant that the composition is effectively released from the carrier sheet onto an article, preferably soiled fabrics as part of a non-immersion cleaning and fabric refreshment process as described herein. This release occurs mainly by volatilization of the composition from the carrier sheet.

The cleaning/refreshment composition preferably comprises water and a member selected from the group consisting of surfactants, perfumes, preservatives, bleaches, auxiliary cleaning agents, organic solvents and mixtures thereof. The preferred organic solvents are glycol ethers, specifically, methoxy propoxy propanol, ethoxy propoxy propanol, propoxy propoxy propanol, butoxy propoxy propanol, butoxy propanol and mixtures thereof. The surfactant is preferably a nonionic surfactant, such as an ethoxylated alcohol or ethoxylated alkyl phenol, and is present at up to about 2%, by weight of the cleaning/refreshment composition. Typical fabric cleaning refreshment/compositions herein can comprise at least about 80%, by weight, water, preferably at least about 90%, and more preferably at least about 95% water.

A more detailed description of the individual components of the cleaning/refreshment compositions, that is, the organic solvents, surfactants, perfumes, preservatives, bleaches and auxiliary cleaning agents can be found in U.S. Pat. No. 5,789,368, which issued on Aug. 4, 1998 to You et al. and in U.S. Pat. No. 5,591,236, which issued on Jan. 7, 1997 to Roetker. The entire disclosure of the You et al. and the Roetker patents are incorporated herein by reference. Additionally, cleaning/refreshment compositions are described in co-pending U.S. patent application Ser. No. 08/789,171, which was filed on Jan. 24, 1997, in the name of Trinh et al. The entire disclosure of the Trinh et al. Application is incorporated herein by reference.

Examples of Soil Removal Compositions

The following are non-limiting examples of soil removal compositions in accordance with the present invention.

TABLE 1

| | A | B | C | D | E |
|---|---|---|---|---|---|
| Lipophilic Fluid | To 100% | To 100% | To 100% | To 100% | To 100% |
| TSF4446[2] | 1% | 3% | — | — | — |
| XS69-B5476[3] | 2% | — | — | — | 2% |
| Jenamine HSX[4] | — | — | 2% | — | — |
| Y12147[5] | — | — | 1% | — | — |
| Aerosol TR-70[6] | — | — | — | 3% | — |
| Oleylamine[9] | — | — | — | 1% | — |
| Hydrogen Peroxide | — | 0.3% | — | — | — |
| Water | 15% | 15% | 5% | 1% | 0.5 |
| Ethanol | — | — | — | — | — |

[1]Decamethylcyclopentasiloxane, available from GE Silicones under the trade name SF 1202 fluid
[2]Polyether-modified Silicone Fluid available from GE Silicones.
[3]Amino-functional siloxane, available from GE Silicones, 60–80% active.
[4]Amino-based silicone co-polyol available from DelCon.
[5]Organo-modified polydimethylsiloxane available from OSi Specialties.
[6]Sodium bistridecyl sulfosuccinate available from Cytec, 70% active.
[9]9-Octadecen-1-amine, available from Akzo Nobel under the trade name Armeen 18D.

TREATED FABRIC ARTICLE

A fabric article that has been treated in accordance a method of the present invention is also within the scope of the present invention. Preferably such a treated fabric article comprises an analytically detectable amount of at least one compound (e.g., an organosilicone) having a surface energy modifying effect but no antistatic effect; or an analytically detectable amount of at least one compound having a surface energy modifying and/or feel-modifying and/or comfort-modifying and/or aesthetic effect and at least one antistatic agent other than said at least one compound.

What is claimed is:

1. A composition for removal of incidental soils from a fabric article comprising:

a) a lipophilic fluid selected from the group comprising linear, branched and cyclic volatile silicones, and mixtures thereof;

b) a surfactant component capable of enhancing soil removal benefits of a lipophilic fluid and/or capable of suspending water in a lipophilic fluid, wherein the surfactant component is selected from the group consisting of a polyether siloxane having alkyleneoxy pendant groups, an organosulfosuccinate surfactant, and mixtures thereof;

c) a polar solvent; and d) at least one additional non-solvent cleaning adjunct, wherein the non-solvent cleaning adjunct is an amino-functional silicone.

2. The composition according to claim 1 wherein said lipophilic fluid comprises from about 60% to about 99.95% by weight of the cleaning composition.

3. The composition according to claim 1 wherein said surfactant component selected from the group consisting of from about 0.01% to about 10% by weight of the cleaning composition.

4. The composition according to claim 1 wherein said surfactant component is a polyether siloxane having at least one of the following properties:

i) siloxane content of at least about 60% by weight;

ii) HLB of from about 0.1 to about 8.

5. The composition according to claim 1 wherein said surfactant component is a dialkylsulfosuccinate wherein the alkyl chains are independently from about C6 to about C20.

6. The composition according to claim 1 wherein said polar solvent comprises from about 2% to about 25% by weight of the cleaning composition.

7. The composition according to claim 1 wherein said polar solvent is water.

8. The composition according to claim 1 wherein said non-solvent cleaning adjunct further comprises a material selected from the group consisting of builders, surfactants, emulsifying agents, enzymes, bleach activators, bleach catalysts, bleach boosters, bleaches, alkalinity sources, antibacterial agent, colorants, perfume, lime soap dispersants, odor control agents, odor neutralizers, polymeric dye transfer inhibiting agents, crystal growth inhibitors, photobleaches, heavy metal ion sequestrants, anti-tarnishing agents, antimicrobial agents, anti-oxidants, anti-redeposition agents, soil release polymers, electrolytes, pH modifiers, thickeners, abrasives, divalent ions, metal ion salts, enzyme stabilizers, corrosion inhibitors, diamines, suds stabilizing polymers, solvents, process aids, sizing agents, optical brighteners, hydrotropes, and mixtures thereof.

9. The composition according to claim 1 wherein said amino-functional silicone has one or more of the following properties:

i) at least about 60% by weight silicone content; and ii) alkyleneoxy groups.

10. The composition of claim 1 wherein the non-solvent cleaning adjunct further comprises a bleach.

11. The composition of claim 1 wherein the non-solvent cleaning adjunct further comprises an enzyme.

12. A composition for removal of incidental soils from fabric articles comprising:

a) from about 60% to about 99.95% by weight of the cleaning composition of linear, branched and cyclic volatile silicones, or mixtures thereof;

b) from about 0.01% to about 10% by weight of the cleaning composition of a surfactant component capable of enhancing soil removal benefits of a lipophilic fluid and/or capable of suspending water in a lipophilic fluid, wherein the surfactant component is selected form the group consisting of a polyether siloxane having alkyleneoxy pendant groups, an organosulfosuccinate surfactant, and mixtures thereof;

c) from about 2% to about 25% by weight of the cleaning composition of polar solvent; and d) from about 0.01% to about 10% by weight of the cleaning composition of an amino-functional siloxane cleaning adjunct.

13. The composition according to claim 12 wherein said lipophilic fluid is decamethylcyclopentasiloxane.

14. The composition according to claim 12 wherein said polar solvent is water.

15. A method for removing incidental soils from fabric articles comprising the steps of:

a) contacting the soiled area of a fabric article with a composition comprising:
   i. a lipophilic fluid;
   ii. a surfactant component capable of enhancing soil removal benefits of a lipophilic fluid and/or capable of suspending water in a lipophilic fluid wherein the surfactant component is selected form the group consisting of a polyether siloxane having alkyleneoxy pendant groups, an organosulfosuccinate surfactant, and mixtures thereof;
   iii. a polar solvent; and
   iv. at least one additional non-solvent cleaning adjunct, wherein the non-solvent cleaning adjunct is an amino-functional silicone;

b) optionally, removing a portion of the composition from the fabric article;

c) optionally, placing the treated fabric article into a subsequent cleaning or refreshing cycle.

16. The method according to claim 15 wherein said lipophilic fluid comprises from about 60% to about 99.95% by weight of the composition.

17. The method according to claim 15 wherein said surfactant component comprises from about 0.01% to about 10% by weight of the composition.

18. The method according to claim 15 wherein said surfactant component is a polyether siloxane having at least one of the following properties:

i) siloxane content of at least about 60% by weight; and
ii) HLB of from about 0.1 to about 8.

19. The method according to claim 15 wherein said surfactant component is a dialkylsulfosuccinate wherein the alkyl chains are independently from about C6 to about C20.

20. The method according to claim 15 wherein said polar solvent comprises from about 2% to about 25% by weight of the cleaning composition.

21. The method according to claim 15 wherein said polar solvent is water.

22. The method according to claim 15 wherein said non-solvent cleaning adjunct further comprises a material selected from the group consisting of builders, surfactants, emulsifying agents, enzymes, bleach activators, bleach catalysts, bleach boosters, bleaches, alkalinity sources, antibacterial agent, colorants, perfume, lime soap dispersants, odor control agents, odor neutralizers, polymeric dye transfer inhibiting agents, crystal growth inhibitors, photobleaches, heavy metal ion sequestrants, anti-tarnishing agents, antimicrobial agents, anti-oxidants, anti-redeposition agents, soil release polymers, electrolytes, pH modifiers, thickeners, abrasives, divalent ions, metal ion salts, enzyme stabilizers, corrosion inhibitors, diamines, suds stabilizing polymers, solvents, process aids, fabric softening agents or actives, sizing agents, optical brighteners, hydrotropes, and mixtures thereof.

23. The method according to claim 15 wherein the optional removal of the composition from said fabric is accomplished by use of an absorbent pad.

24. The method according to claim 15 wherein the optional removal of the composition from said fabric is accomplished by use of a vacuum table.

25. The method according to claim 15 wherein said optional placing the treated fabric article into a subsequent cleaning or refreshing process is selected from the group consisting of conventional aqueous washing, dry-cleaning and home dry-cleaning.

26. The method according to claim 15 wherein the composition comprises:

i. from about 88 to about 99.8% by weight of the composition of lipophilic fluid;
ii. from about 0.01 to about 10% by weight of the composition of surfactant component;
iii. from about 2% to about 25% by weight of the composition of polar solvent; and
iv. from about 0.01 to about 10% by weight of the composition of amino-functional siloxane material.

27. An overall dry cleaning process for treating an entire area of a fabric surface comprising the overall steps of:

(i) conducting a soil removal method according to claim 15, on localized soiled areas of the fabric surface;
(ii) placing the entire fabric from step (i) together with a carrier containing an aqueous cleaning composition in a containment bag;
(iii) placing the bag in a device to provide agitation and agitating said bag; and
(iv) removing the fabric from the bag.

28. The process according to claim 27 wherein step (iii) is conducted in a hot air clothes dryer.

29. An overall laundering process for fabrics comprising the overall steps of:

(i) conducting a soil removal method according to claim 15 on localized soiled areas of the fabrics; and
(ii) laundering the entire fabrics from step (i) in a conventional aqueous laundering process.

30. An overall laundering process for fabrics comprising the overall steps of:

(i) conducting a soil removal method according to claim 15 on localized soiled areas of the fabrics; and
(ii) laundering the entire fabrics from step (i) in a conventional dry cleaning process.

31. A product comprising a soil removal composition according to claim 1, said product further comprising instructions for contacting a stained area of an article with said stain removal composition.

32. A kit comprising a product according to claim 31.

33. A fabric article treated by the method according to claim 15.

34. A fabric article treated by the method according to claim 26.

* * * * *